US007510458B2

(12) United States Patent
Thomas

(10) Patent No.: US 7,510,458 B2
(45) Date of Patent: Mar. 31, 2009

(54) BIT SHARPENING APPARATUS AND METHOD OF USING

(76) Inventor: Charles M. Thomas, P.O. Box 761, Wilson, WY (US) 83014

( * ) Notice: Subject to any disclaimer, the term of this patent is extended or adjusted under 35 U.S.C. 154(b) by 0 days.

(21) Appl. No.: 11/291,443

(22) Filed: Dec. 1, 2005

(65) Prior Publication Data

US 2006/0121829 A1 Jun. 8, 2006

Related U.S. Application Data

(60) Provisional application No. 60/633,404, filed on Dec. 4, 2004.

(51) Int. Cl.
*B24B 49/12* (2006.01)

(52) U.S. Cl. ..... 451/6; 451/279; 451/293

(58) Field of Classification Search ..... 451/6, 451/5, 11, 367, 374, 380, 279, 293
See application file for complete search history.

(56) References Cited

U.S. PATENT DOCUMENTS

| | | | | |
|---|---|---|---|---|
| 1,079,420 | A | 11/1913 | MacKay | |
| 2,729,923 | A | 1/1956 | Durst | |
| 3,149,444 | A | 9/1964 | Schneider | |
| 3,683,564 | A | 8/1972 | Lawrence | |
| 3,828,486 | A | 8/1974 | Bonke | |
| 3,952,616 | A | 4/1976 | Varley | |
| 4,142,332 | A * | 3/1979 | Clarke | 451/278 |
| 4,270,315 | A * | 6/1981 | Reiling et al. | 451/375 |
| 5,582,542 | A | 12/1996 | Steain | |
| 5,649,853 | A | 7/1997 | Kuo | |
| 5,727,991 | A | 3/1998 | Main | |
| 5,816,898 | A | 10/1998 | Wirth et al. | |
| 6,234,881 | B1 | 5/2001 | Martin, Jr. | |
| 6,283,830 | B1 | 9/2001 | Kuo | |
| 6,287,177 | B1 | 9/2001 | Shaffer | |
| 6,676,495 | B1 | 1/2004 | Siemers et al. | |
| 6,808,440 | B2 | 10/2004 | Mundt | |
| 6,811,362 | B2 | 11/2004 | Wallin et al. | |
| 6,942,551 | B2 | 9/2005 | Mizek et al. | |

FOREIGN PATENT DOCUMENTS

| | | | | |
|---|---|---|---|---|
| FR | 711709 | * | 9/1931 | 451/374 |
| SU | 565812 | * | 7/1977 | 451/367 |

* cited by examiner

*Primary Examiner*—Robert Rose
(74) *Attorney, Agent, or Firm*—Tarolli, Sundheim, Covell & Tummino LLP

(57) ABSTRACT

An apparatus 40 for sharpening a router or shaper bit 12 of the type having a flat cutting face 18. The apparatus 40 includes a chuck 64 holding the cutting bit 12. A grinding wheel 108 has a flat grinding face 110 and a grinding wheel shaft 116 on which the grinding wheel 108 rotates. A chuck support supports the chuck 64 and positions it so that the bit cutting face 18 is in a plane parallel to and in front of the flat face 110 of the grinding wheel 108. A side adjustment plate 46 has an index dial by which the side adjustment plate 46 is moved incrementally, in small amounts, to move the cutting face 18 of bit 12 into and against the grinding wheel face 110 during the grinding process. A carriage plate 44 permits moving the bit 12 back and forth in a plane perpendicular to the grinding wheel shaft. A laser 314 directs a beam onto a mirror 318 affixed to the bit cutting face 28.

13 Claims, 7 Drawing Sheets

BIT SHARPENING APPARATUS AND METHOD OF USING

RELATED APPLICATION

This application claims the benefit of the Provisional U.S. Patent Application Ser. No. 60/633,404 filed Dec. 4, 2004 entitled Bit Sharpening Apparatus and Method of Using. The benefit of the earlier filing date of the aforementioned application Ser. No. 60/633,404 is hereby claimed. The disclosure in the aforementioned application Ser. No. 60/633,404 is hereby incorporated herein in its entirety by this reference thereto.

BACKGROUND OF THE INVENTION

Technical Field

The present invention relates to a new and improved apparatus and method for sharpening tool bits, particularly a carbide router or shaper bit.

BRIEF DESCRIPTION OF THE PRIOR ART

Routers and shapers have become two of the most important tools in a woodworker's shop. A router and shaper bit sharpening device must meet three criteria to be desirable to non-professional sharpeners. It must be inexpensive, easy to use, and effective. No conventional sharpener has achieved these goals. Professional grinding equipment can cost up to five hundred thousand dollars. Inexpensive devices are difficult to use and ineffective.

To use any router bit sharpening device, the face of the router bit blade must first be made parallel to the face of a grinding wheel. With conventional sharpeners, this is achieved by coloring the face of the blade, attempting to align the blade by eye, and then swiping the blade with the grinding wheel to check if it is parallel. Inevitably it must be readjusted several times and even then it is never quite right. With small router or shaper bits, this alignment is all but impossible. The small bits have so little surface area on the face of the blade that it is difficult to make the blade parallel to the face of a grinding wheel.

Existing router bit sharpeners are designed to bring the bit into contact with the face of a grinding wheel by sliding the bit holder, during sharpening, in a direction perpendicular to the grinding wheel shaft. Any minute play in the sharpening machine or the grinding wheel results in a rounding over of the front edge of the router bit blade. While very high quality sharpeners have minimal play, the rounding over of the front edge of the bit is still a problem. The rounding over is much more acute with less expensive machines.

The prior art is illustrated in prior U.S. Pat. No. 5,816,898. The device of the patent is used with a grinding wheel mounted in a drill press. Referring in particular to FIG. 4 of the patent, a sharpening device is shown comprising a head 18 mounted on a head support 62. The head 18 supports a chuck 16 into which a bit is inserted. The bit is rotated in the chuck until the leading edge of the bit is generally parallel to the drill press table, and the bit is tightened in the chuck. This is a coarse adjustment for the so-called "hook" angle of the bit. The adjusting screw 72 is then turned to adjust the so-called "shear" angle of the bit bringing the face of the bit into a plane generally parallel to the face of the grinding wheel. The drill press is lowered until the drill press is directly over the bit to determine how parallel the face of the bit is to the grinding wheel. This adjustment process is repeated if necessary. The grinding wheel is turned on. The bit is brought in until the cutting face touches the wheel. The bit is then slid back and forth with the cutting face under the grinding wheel in a motion perpendicular to the grinding wheel shaft until sharpening is completed.

Any play in the system, inconsistencies in the table top, in the wheel, the drill press, or any other component of the apparatus, is translated to the critical point of contact between the bit cutting face and the edge of the grinding wheel resulting in rounding of the front edge of the bit.

It is an object of the present invention to provide a bit sharpening apparatus that is easier to use and achieves better quality sharpening.

It is further an object of the present invention to provide a bit sharpening apparatus or machine that minimizes the effects of play or inconsistencies in the machine. This decreases the tolerances to which the machine needs to be built allowing manufacture of the machine at a more reasonable cost affordable to small woodworkers and non-professional sharpeners.

BRIEF DESCRIPTION OF THE PRESENT INVENTION

The apparatus of the present invention is for sharpening router and shaper bits, particularly carbide router and shaper bits. The router and shaper bits to which the present invention is directed have one or more outwardly extending blades having a flat face and a cutting edge. Sharpening is achieved by grinding the bit face. The sharpening apparatus of the present invention comprises a chuck for holding the bit. A chuck support positions the chuck so that the bit cutting face is in a plane parallel to and in front of the face of a grinding wheel. A carriage brings the face of the blade into contact with the face of the grinding wheel in a motion parallel to the grinding wheel shaft. Play and inconsistencies in component parts are minimized by the press of the blade face against the grinding wheel face in the direction parallel to the grinding wheel shaft.

For purposes of the present application, the term "in front of", with reference to the location of the bit cutting face with regard to the grinding wheel face, means that the bit cutting face is within or encompassed by an imaginary cylinder generated by extending the edge of the grinding wheel in a direction parallel to the grinding wheel shaft.

Preferably, the sharpening apparatus of the present invention comprises an index means for moving the bit cutting face incrementally in small amounts into and against the grinding wheel face, and continuing such movement until sharpening is complete.

The present invention also comprises an elongated thin magnetic strip that is attachable to the bit cutting face. The magnetic strip extending from the bit cutting face exaggerates any angular deviation between the orientation of the bit cutting face and the grinding wheel face facilitating accurate adjustment of the bit cutting face so that it is parallel to the grinding wheel face.

In a preferred embodiment of the present invention, the chuck support comprises first and second adjusting means. The first adjusting means adjusts the rotational angle of the bit so that the cutting face of the bit is in a plane that has the same orientation with respect to the vertical as the face of the grinding wheel. The second adjusting means adjusts the angular orientation of the chuck support with respect to the grinding wheel so that the bit cutting face is in a plane parallel to the face of the grinding wheel. A positioning means positions the chuck support so that the bit cutting face is in front of but spaced from the grinding wheel face. An advancing means moves the bit cutting face against the grinding wheel face in a motion parallel to the grinding wheel shaft.

Preferably, the sharpening apparatus of the present invention comprises an index means that advances the bit cutting face incrementally into the grinding wheel face.

The present invention also resides in a method for sharpening a router or shaper bit having a flat cutting face. The bit is positioned in a bit holder. The holder is positioned so that the bit cutting face is parallel to and in front of the face of a grinding wheel. The grinding wheel face and the bit cutting face are then brought together in a direction that is parallel to the grinding wheel shaft.

In an embodiment of the present invention, the bit is first positioned in a chuck, and the chuck is rotated so that the bit cutting face is in a plane that has the same orientation with respect to the vertical as the face of the grinding wheel. The chuck is in a chuck holder and the chuck holder is pivoted so that the bit cutting face is in a plane parallel to the plane of the grinding wheel face. The chuck holder is then positioned so that the bit cutting face is in front of and parallel to the grinding wheel face. The chuck holder is then advanced to move the bit cutting face against and into the grinding wheel face in a direction that is parallel to the grinding wheel shaft.

BRIEF DESCRIPTION OF THE DRAWINGS

The invention and advantages thereof will become more apparent from the following detailed description of the present invention with reference to the accompanying drawings, in which.

DETAILED DESCRIPTION OF THE PRESENT INVENTION

Figure 5:
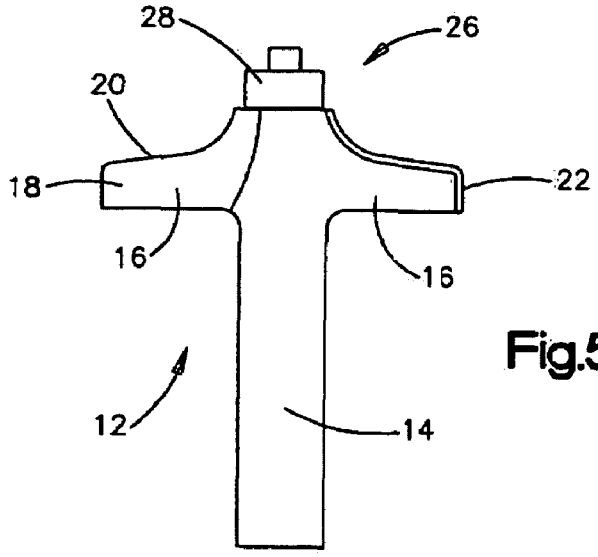
FIG. 5 is an enlarged elevation view of a router bit capable of being sharpened by the apparatus of FIG. 1.
Figure 5A:
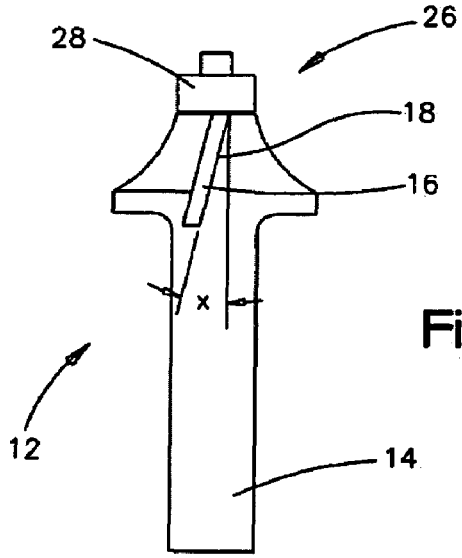
FIG. 5A if an elevation view of the router bit of FIG. 5 taken at right angles to the view of FIG. 5.
Figure 5B:
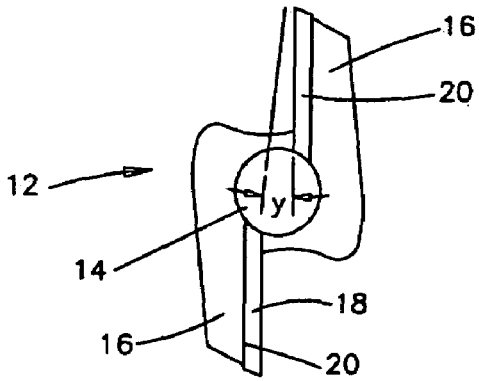
FIG. 5B is an end view of the router bit of FIG. 5 taken from the front end of the bit.

Router bits, also referred to as shaper bits, are a somewhat recent development dating back to the mid-1900's. The bits are unique and very distinguishable from a conventional drill bit. An example of a router bit is shown in FIGS. 5, 5A, and 5B. The bit 12 has a cylindrical shaft 14. Blades 16 extend tangentially outwardly from the shaft 14. In the embodiment of FIG. 5, 5A and 5B, two blades 16 are shown. The bit can have only one blade, or two or three blades. The bit rotates in a counter-clockwise direction, looking from the front end 26 as in FIG. 5B. Each blade 16 has a flat face 18, visible in FIGS. 5 and 5B. Each face 18 is at an angle "Y", of 90 degrees or less to a transverse section of the bit, as shown in FIG. 5B. The angle "Y" is known as the hook angle. The blade 16 (FIG. 5) also has a cutting edge 20, facing the end 26 of the bit, and an outer, annular cutting edge 22. Both cutting edges 20 and 22 are faced with a layer 24 of carbide steel, about one-eighth inch thick. The end 26 of the shaft 14, in the Example of FIG. 5, supports a roller bearing 28.

The cutting edge 20 of the bit 12, in the embodiment of FIG. 5, is contoured with a concave shape. The roller bearing 28 functions as a guide for the router bit, resting against the surface of a piece of wood being contoured. The cutting edge 20 provides the wood with the contour of the edge 20 during the cutting process. Different router bits can have different contours 20 depending upon the shape of the cut that is desired.

The cutting is a slicing action. To accomplish this the blade face 18 is given an angle that deviates from the axis of the bit, angle "X" in the view of FIG. 5A. The angle "X" is known as the shear angle.

Regardless of the geometry of the router bit, the flat face 18 is the surface that is ground to sharpen the bit. In the sharpening process, a grinding wheel having a flat face is used, and the bit face 18 is ground against the grinding wheel flat face.

Because of the unique angles "X" and "Y" of the bit face 18, which vary from bit to bit depending on the use intended for the bit, and because of the small surface areas of the bit face 18, it is difficult to provide a machine which is capable of universal, easy and accurate orientation of the bit face 18.

Figure 1:
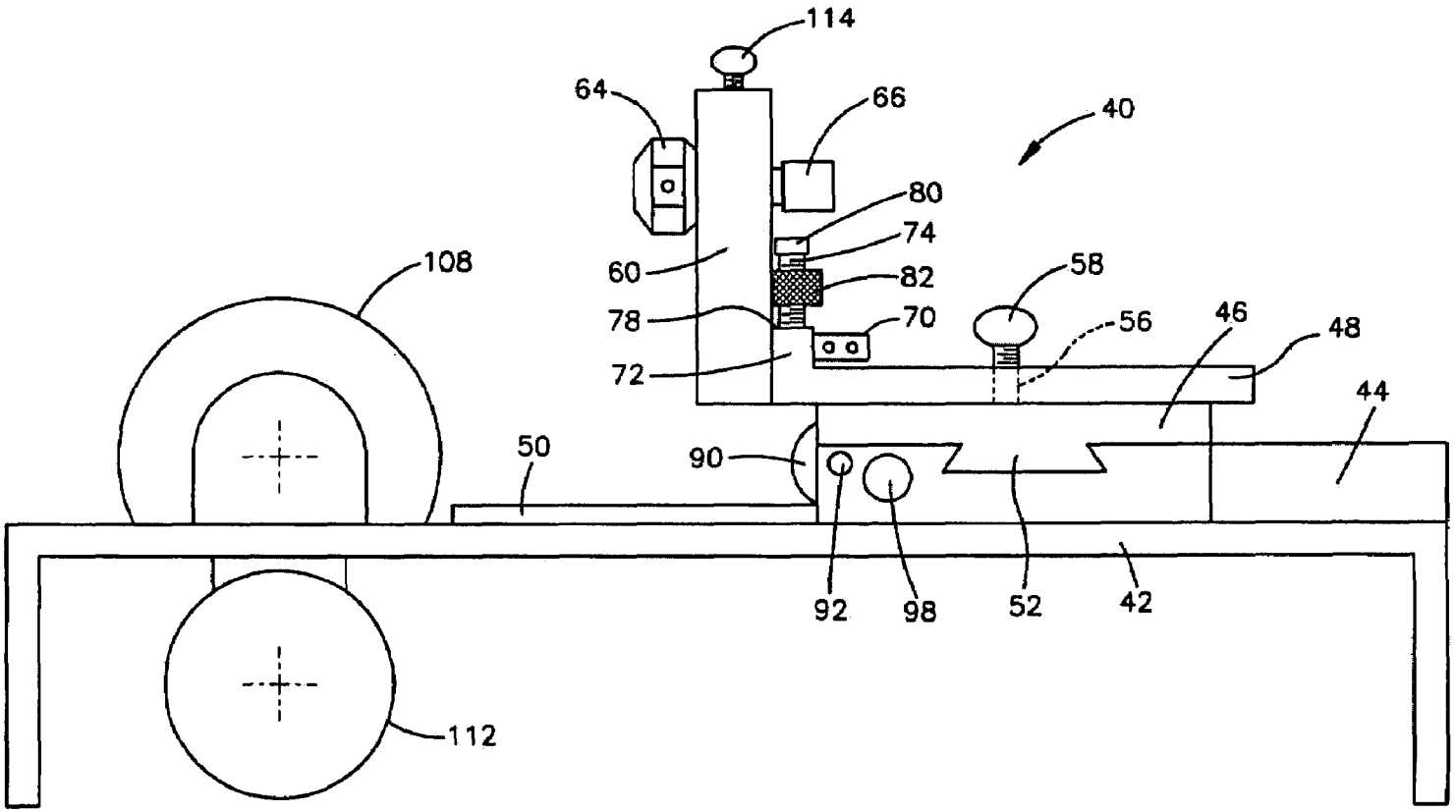
FIG. 1 is a side elevation view of a cutting bit sharpening apparatus in accordance with the present invention.
Figure 2:
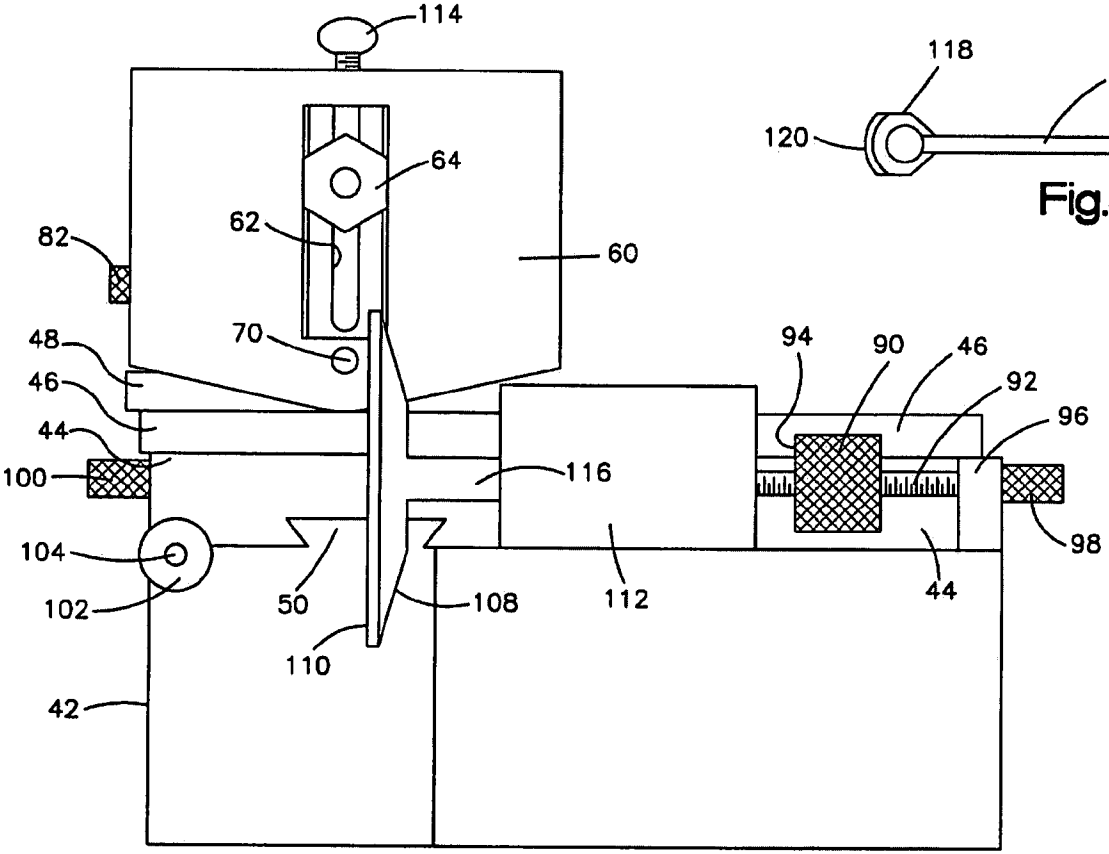
FIG. 2 is a front elevation view of the apparatus of FIG. 1.
Figure 3:
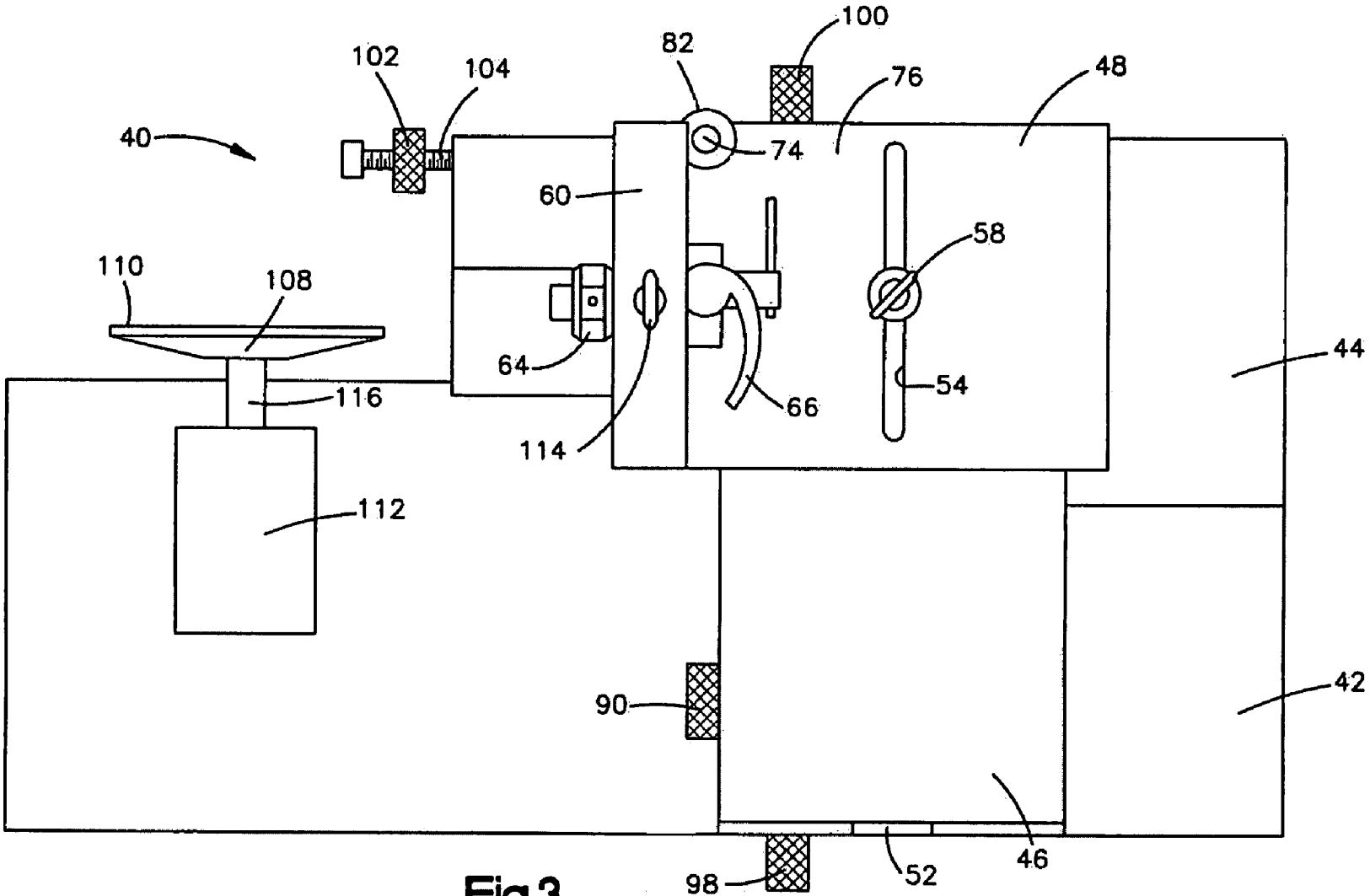
FIG. 3 is a plan view of the apparatus of FIG. 1.

The cutting bit sharpening apparatus of the present invention is shown in FIGS. 1, 2, and 3. The sharpener comprises a base 42. Three plates 44, 46, and 48 are supported on the base 42. The plates 44, 46, and 48 are in a stacked relationship, one on top of the other, as shown in FIG. 1.

The lower of the three plates, carriage plate 44, moves forward and backward longitudinally on the base 42 (to the right or left in FIG. 1), confined to the forward and backward movement by a longitudinally extending dovetail track 50 (FIGS. 1 and 2) on the upper surface of the base 42. Guide means other than a dovetail track can be used, for instance a pair of rails gripped by ball bearing sleeves on the bottom of the carriage plate.

The second of the three plates, side adjustment plate 46, is mounted on top of the carriage plate 44. The side adjustment plate 46 is confined to sideways left and right movement, with respect to the carriage plate 44, by a dovetail track 52 extending laterally in the upper surface of the carriage plate 44 (see FIG. 1). Here also, guide means other than a dovetail track can be used.

The upper of the three stacked plates, pivot plate 48, pivots on top of the side adjustment plate 46. The pivot plate 48 has a laterally oriented slot 54 (see FIG. 3). A set-screw 58 extends through slot 54 and is threaded into the upper surface of the side adjustment plate 46. The pivot plate 48 pivots on the set-screw 58. The pivot plate 48 is also capable of sideways movement. However, it is confined in such movement by the set-screw 58 in the slot 54. The set-screw 58 can be turned or tightened down to clamp the pivot plate 48 against the side adjustment plate 46 to prevent movement of the pivot plate, sideways or rotational, relative to the side adjustment plate 46.

The pivot plate 48 supports a vertical plate 60 (FIG. 1) mounted on the front end of the pivot plate 48. The vertical plate 60 has a vertically oriented slot 62 (FIG. 2). A chuck 64 is movable up and down in the slot 62. The chuck 62 comprises a quick release cam 66 (FIGS. 1 and 3) which bears against the rear side of the vertical plate 60 and holds the chuck 64 in position once it is moved to the desired elevation.

The vertical plate 60 pivots on release/lock shaft 70 (FIGS. 1 and 2). The shaft 70 supports the vertical plate 60 and extends through an upright flange 72 (FIG. 1) at the front end of the pivot plate 48. A vertical plate adjusting screw 74 (FIG. 1) is positioned at one side 76 of the pivoting plate 48 (as shown in FIG. 3). The adjusting screw 74 bears against the upper edge 78 (FIG. 1) of the flange 7 2. A knurled knob 82 is threaded onto the adjusting screw 74. The knurled knob 82 fits into a slot (not shown) on the backside of the vertical plate 60. Turning the knurled knob 82 (FIGS. 1, 2, and 3) tilts the vertical plate 60. This fine tunes the angular adjustment of the vertical plate 60 and thus the orientation of the cutting face 18 (FIG. 5) of a bit relative to the face of a grinding wheel, as will be described.

The side adjustment plate 46 is moved sideways on the upper dovetail track 52 by careful adjustment of a numbered dial 90 (FIG. 2). The numbered dial 90 is threaded onto bolt 92 set laterally in a flange 96 of the carriage adjustment plate 44. The numbered dial 90 and the bolt 92 are also shown in FIG. 1. The side adjustment plate 46 has a slot 94 cut into the underside of the plate 46. The numbered dial 90 seats in and is engaged by the slot 94. Turning the dial 90 on the bolt 92 moves the side adjustment plate 46 sideways on the dovetail track 52 (FIG. 1).

The carriage plate 44 is moved forward and backward along the lower dovetail track 50 on base 42 by gripping the handles 98 and 100 (FIGS. 1, 2 and 3) on opposite sides of the carriage plate 44. A stop 102 (FIGS. 2 and 3) is provided mounted on threaded bolt 104 extending forward from base 42. The carriage plate 44 is pushed forward up against the stop 102. The position of the stop 102 on the bolt 104 is adjusted by rotating the stop 102 on the bolt 104.

The sharpener of the present invention also comprises a conventional grinding wheel 108 mounted on shaft 116. The wheel 108 has a flat, raised, annular, diamond abrasive, grinding face 110 (FIGS. 2,3) on the front side of the wheel. The annular raised face 110 is narrow, for instance about one quarter inch wide. The grinding wheel 108 is driven by motor 112. In the present invention, a very fine grinding wheel face is used, for instance a 400 grit wheel. Conventional grinders that rely on movement of the bit in a direction perpendicular to the grinding wheel shaft also rely on the removal of a relatively large amount of material, and generally use much coarser wheels, for instance a 120 grit wheel. In the present invention, the removal of large amounts of material is not necessary.

The sharpener of the present invention also comprises an elongated, thin metallic strip 116 (FIG. 5). The strip 116 has a head 118 at one end. A pair of rare earth magnets 120 is embedded in the head 118. The strip 116 is several inches long, and narrow in width.

Operation of the sharpening device of the present invention is as follows.

A bit is placed in the chuck 64. It is necessary to position the bit cutting face so that it is in a plane parallel to the grinding face 110 of the abrading wheel 108. This is accomplished in a two step process.

The first step is adjustment of the chuck 64. The bit to be sharpened is spun in the chuck until a cutting face 18 (FIG. 5) of the bit is essentially vertical, or generally in a plane that has the same orientation with respect to the vertical as the face 110 of the grinding wheel 108. The bit is then tightened in the chuck. The thin magnetic strip 116 (FIG. 4) is attached to the cutting face 18. The vertical plate 60 pivots on the pivot plate flange 72. This pivoting motion of the vertical plate 60 is used to fine tune the vertical orientation of the bit cutting face 18 once the bit is tightened in the chuck 64. The fine tuning is accomplished by turning the knurled knob 82 (FIGS. 1 and 3) which raises or lowers the right hand side of the vertical plate 60 tilting the vertical plate 60. The magnetic strip 116 exaggerates the angular deviation of the bit cutting face with respect to the face 110 of the grinding wheel. This allows the operator to adjust the bit cutting face simply by eye balling the orientation of the magnetic strip with respect to the grinding wheel face 110; or a line parallel to the grinding wheel face, e.g., a laser generated line.

The second adjustment is made by pivoting the pivot plate 48 on the set-screw 58. The set-screw 58 is loosened. The pivot plate 48 is moved sideways by guiding the plate 48 along slot 54 (FIG. 3) on the set screw 58 until the bit cutting face 18 is more or less in a plane parallel to the grinding face 110 of the abrading wheel 108. Then the pivot plate 48 is pivoted on the set screw 58, again aided by the exaggerated angle provided by the magnetic strip 116, until the bit cutting face 18 and the abrading wheel grinding face 110 are in exactly parallel planes. The set screw 58 is then tightened.

The quick release 66 of the chuck 64 is loosened and the chuck 64 is raised or lowered in the vertical slot 62 of the vertical plate 60 to bring the bit cutting face 18 to the desired height relative to the face 110 of the grinding wheel 108. The quick release 66 is then tightened. A set-screw 114 (FIGS. 1,2, and 3), set in the top of the vertical plate 60, is turned so that it bears against the upper surface of the chuck 64. This assures that the chuck 64 can be returned to the desired height when displaced from that height while repositioning the chuck, as will be described further on. At this point, the stop 102 is also set.

To sharpen the bit cutting face 18, the operator of the bit sharpening apparatus grabs the handles 98 and 100 of the carriage plate 44 and slides the carriage plate 44 forward on the base 42. This forward movement is maintained until the carriage plate 44 is against stop 102. The bit cutting face 18 is in front of but slightly spaced from the face 110 of the grinding wheel 108. The motor 112 is turned on causing the grinding wheel 108 to revolve. The operator turns the numbered dial 90 (FIG. 2) to move the side adjustment plate 46 sideways (to the right in the view of FIG. 2) on dovetail track 52 closing the gap between the bit cutting face 18 and the grinding wheel face 110. This brings the bit cutting face 18 into and against the grinding wheel face 110 in a motion parallel to the grinding wheel shaft 116. The operator then turns numbered dial 90 incremental amounts to move the bit cutting face 18 further, by small amounts, into the grinding wheel face 110. At the same time, the operator moves the carriage plate 44 back and forth small amounts in a plane perpendicular to the plane of the grinding wheel shaft 116, using handle 98 or 100, to completely grind the face.

Moving the bit cutting face 18 into the face 110 of the grinding wheel 108 in a motion that is parallel to the grinding wheel shaft 116 is an important aspect of the sharpening process and apparatus of the present invention. Once the face 18 has been sharpened, the dial 90 is reversed drawing the bit from the grinding wheel 108, again in a motion that is parallel to the grinding wheel shaft. By moving the bit to and away from the grinding wheel face 110 in a plane parallel to the grinding wheel shaft 116, in small increments, it was found that distinctly improved sharpening of the bit cutting face 108 could be achieved. The bits were found to be sharper than when received from the factory.

Figure 4:
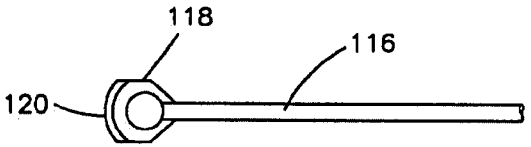
FIG. 4 is a side elevation view of a thin magnetic strip used in the sharpening of a cutting bit using the bit sharpening apparatus of FIG. 1.

In the embodiment of FIG. 4, the bit 12 has two cutting faces 18. The second face is sharpened as follows. The operator carefully notes the number on the numbered dial 90 at which the sharpening process on the first cutting face was stopped. The numbered dial 90 is then turned in the reverse direction to back the bit 12 away from the grinding wheel face 110. The quick release 68 for the chuck 64 is then loosened, and the chuck is turned 180 degrees. The chuck 64 is a conventional six-sided member. Turning the chuck 180 degrees in the slot 62 of the vertical plate 60 brings the second cutting face of the two bladed bit into a plane parallel to the abrading wheel grinding face 110. The desired height of the chuck 64 in the slot 62 is achieved by sliding the chuck 64 up until it contacts the set-screw 114. If the bit 12 has three blades, then the chuck 64 is turned only 120 degrees, using the hexagonal shape of the chuck to expose the second cutting face 18 to the abrading wheel grinding face 110. The third cutting face is exposed to the abrading wheel grinding face 110 by turning the chuck an additional 120 degrees. Once the second or third cutting face 18 has been suitably positioned, it is advanced into the grinding wheel face 110 by turning the numbered dial 90 and following the same procedure described above.

Figure 6:
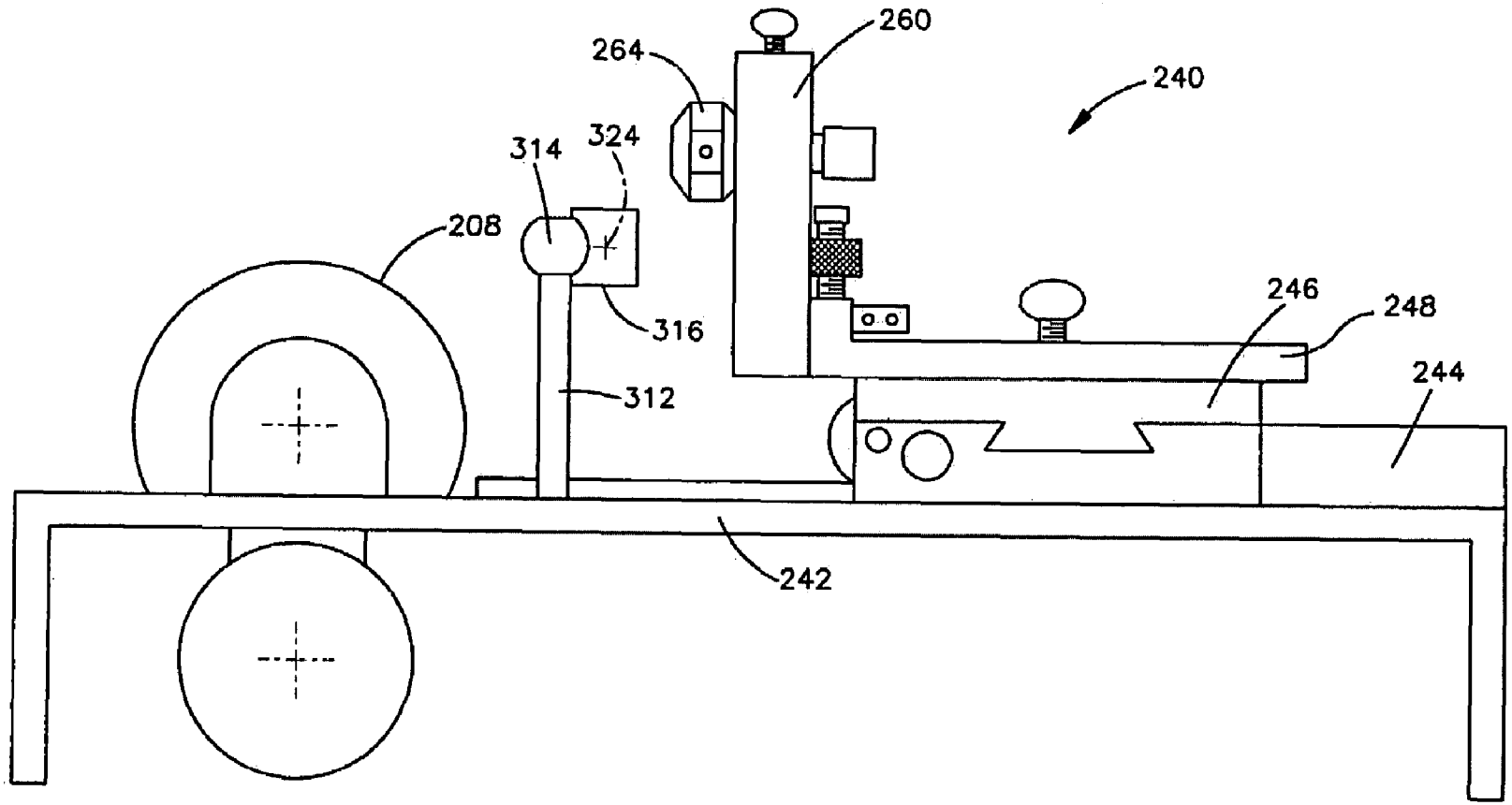
FIG. 6 is a side elevation view illustrating a cutting bit sharpening apparatus in accordance with an embodiment of the present invention.
Figure 7:
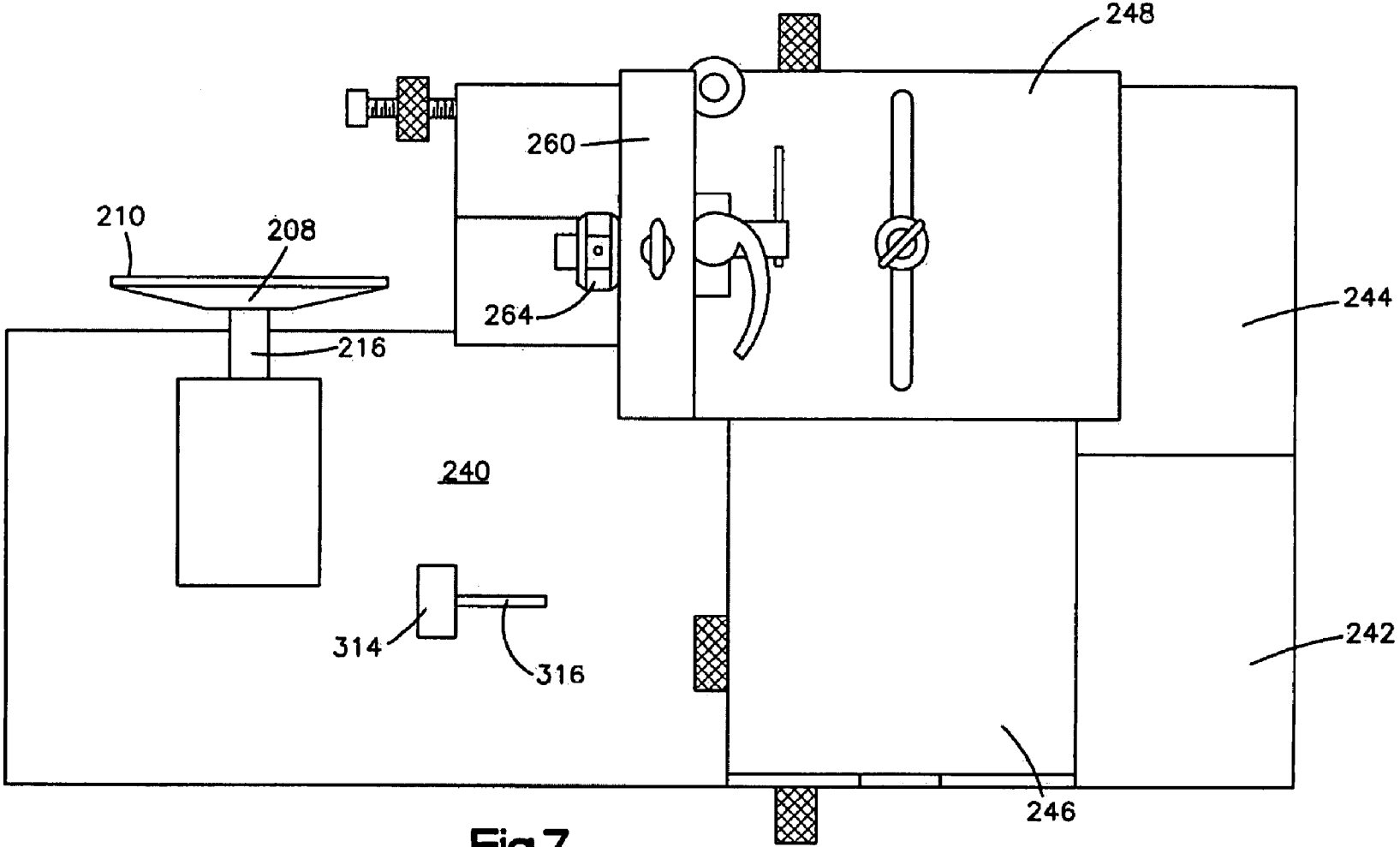
FIG. 7 is a plan view of the apparatus of FIG. 6.

An embodiment of the present invention is illustrated in FIGS. 6, 7, 8, 8A, and 8B. The flat face of the router bit 12 (FIGS. 8, 8A, and 8B) is aligned with the flat face 210 (FIG. 7) of a grinding wheel 208 by using a laser beam. This is illustrated in FIGS. 6 and 7. Referring to these Figures, a mounting post 312 supports a laser 314. The post 312 is positioned on base 242 of sharpening apparatus 240 behind the grinding wheel 208, and to the right of the grinding wheel or about midway between the grinding wheel 208 and chuck 240, as shown in FIG. 7. The post extends vertically upright from the base 242 as shown in FIG. 6.

The laser 314 is mounted on top of the post 312 and is aimed in a direction parallel to the grinding wheel shaft 216. The laser 314 is at about the same elevation as the top of the grinding wheel 208. The laser 314 has a target 316 extending vertically from the side of the laser 314. The target 316 is in a plane that is perpendicular to the orientation of the laser 314 and parallel to the flat grinding face 210 of the grinding wheel 208.

Figure 8:
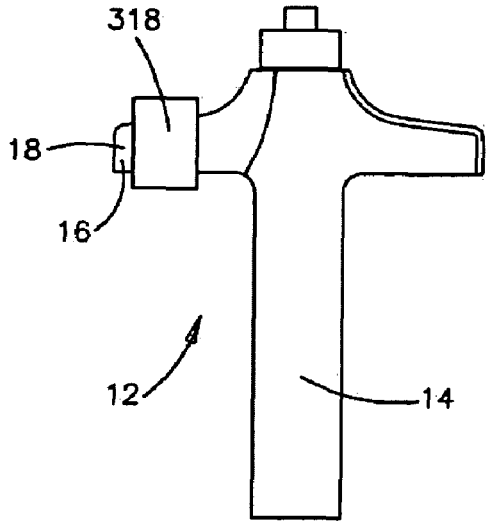
FIG. 8 is an enlarged elevation view of a router bit capable of being aligned by the apparatus of FIG. 6.
Figure 8A:
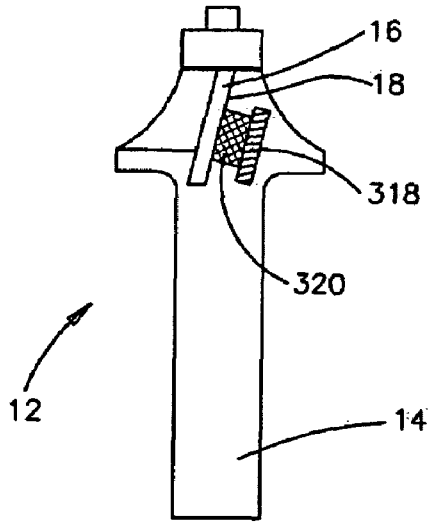
FIG. 8A is an elevation view of the router bit of FIG. 8 taken at right angles to the view of FIG. 8.
Figure 8B:
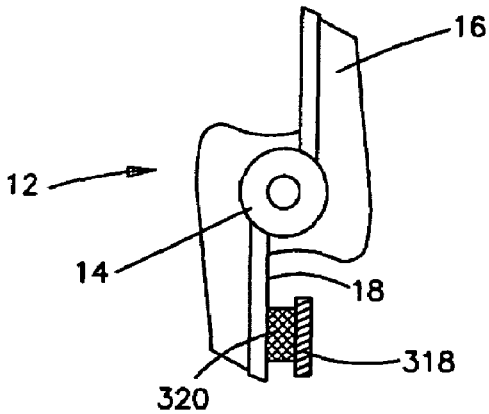
FIG. 8B is an end view of the router bit of FIG. 8 taken from the front end of the bit.

A mirror 318 is attached to the router bit flat face 18 as shown in FIGS. 8, 8A, and 8B. The mirror 318 is affixed to a magnet 320 that adheres to the bit flat face 18. The chuck 264 is adjusted on vertical plate 260 so that it is at about the same elevation as the laser beam. The carriage plate 244 is moved forward towards the grinding wheel 208 until the laser beam hits the magnetized mirror 318. The target 316 has a horizontal line 324 and a vertical line 326 drawn on it defining a cross hair target. The bit 12 is rotated in the chuck 264 until the reflected beam hits the horizontal line 324. The pivot plate 248 is then pivoted until the reflected beam hits the target vertical line 326. These two adjustments orient the surface to be sharpened so that the bit flat face 14 is accurately aligned with the grinding wheel flat face 110.

From the above description of the present invention, those skilled in the art will perceive improvements, modifications and changes. Such improvements, modifications and changes within the skill of the art are intended to be covered by the appended claims.

What is claimed is:

1. A sharpening apparatus for a router or shaper cutting bit having a flat cutting face comprising;

a. a chuck for holding the cutting bit;

b. a chuck support positioning the chuck so that the bit cutting face is in a plane parallel to and in front of the flat face of a grinding wheel;

c. advancing means to move said bit cutting face into contact with said grinding wheel face in a motion parallel to the grinding wheel shaft;

d. means for backwards and forwards movement of said bit cutting face relative to the grinding wheel face in small amounts in a motion perpendicular to the shaft of the grinding wheel during sharpening; and e. an elongated magnetic strip attachable to the bit cutting face to exaggerate the angular deviation of the bit cutting face with respect to the face of the grinding wheel.

2. A sharpening apparatus for a cutting bit having a flat face comprising;

a. a chuck for holding the cutting bit;

b. an grinding wheel having a flat face and a grinding wheel shaft;

c. a chuck support including means for adjusting a rotational angle of the bit so that the bit cutting face is in a plane that has the same orientation with respect to the vertical as said grinding wheel face;

d. a plurality of support plates in a stacked relationship comprising;

i. a pivot plate supporting the chuck support for rotating the chuck support so that the bit cutting face is in a plane parallel to the grinding wheel face;

ii a carriage plate to position the chuck support and pivot plate so that the bit cutting face is spaced in front of the grinding wheel face;

iii. a side adjustment plate between the carriage plate and pivot plate to move the bit cutting face into and against the grinding wheel face in a motion parallel to the grinding wheel shaft; and e. index means to move said side adjustment plate in small increments.

3. The sharpening apparatus of claim 2 including an elongated magnetic strip removably attachable to the bit cutting face to exaggerate the angular deviation of the bit cutting face with respect to the face of the grinding wheel and facilitate the adjustment of the bit cutting face into a plane parallel to the grinding wheel face.

4. The sharpening apparatus of claim 2 wherein the grinding wheel has a fine grit diamond surface.

5. A sharpening apparatus for sharpening a cutting bit wherein the cutting bit has a flat face comprising;

a. a chuck adapted to hold the cutting bit;

b. a grinding wheel having a flat face;

c. a chuck support adapted to bring the cutting bit flat face into engagement with the grinding wheel flat face;

d. a laser;

e. a target contiguous to the laser; the laser being positioned to deflect a laser beam off the bit flat face onto said target;

f. adjustment means adapted to pivotally adjust the bit flat face on both a vertical axis and a horizontal axis; and g. said laser and target being positioned so that focusing the deflected beam onto the target accurately aligns the bit flat face with the grinding wheel flat face.

6. The sharpening apparatus of claim 5 further comprising:

a. a mirror adapted to be affixed to the cutting bit flat face, b. the laser being positioned to deflect a laser beam off said mirror onto a target;

c. the chuck comprising adjustment means for rotatably adjusting the bit in the chuck to focus the deflected beam onto the target, the chuck support comprising pivot adjustment means for pivotally orientating the bit and focusing the deflected beam onto the target.

7. A sharpening apparatus for a router or shaper cutting bit having a flat cutting face comprising;

a. a chuck for holding the cutting bit;

b. a chuck support positioning the chuck so that the bit cutting face is in a plane parallel to and in front of the flat face of a grinding wheel;

c. advancing means to move said bit cutting face into contact with said grinding wheel face in a motion parallel to the grinding wheel shaft;

d. means for backwards and forwards movement of said bit cutting face relative to the grinding wheel face in small amounts in a motion perpendicular to the shaft of the grinding wheel during sharpening; and e. a laser for accurately orienting the bit cutting face prior to sharpening.

8. A sharpening apparatus for a router or shaper cutting bit having a flat cutting face comprising;

a. a chuck for holding the cutting bit;

b. a chuck support positioning the chuck so that the bit cutting face is in a plane parallel to and in front of the flat face of a grinding wheel;

c. advancing means to move said bit cutting face into contact with said grinding wheel face in a motion parallel to the grinding wheel shaft;

d. means for backwards and forwards movement of said bit cutting face relative to the grinding wheel face in small amounts in a motion perpendicular to the shaft of the grinding wheel during sharpening; and e. means for adjustment of the bit cutting face, prior to sharpening, in a plane parallel to the grinding wheel face and perpendicular to the grinding wheel shaft.

9. A sharpening apparatus for a cutting bit having a flat face comprising:

a. a chuck for holding the cutting bit;

b. a grinding wheel having a flat face;

c. a chuck support including means for adjusting the orientation of the bit so that the bit cutting face is in a plane that has the same orientation with respect to the vertical as the grinding wheel face; and d. an elongated magnet ship removably attachable to the cutting bit face to exaggerate angular deviation of the cutting bit face with respect to the face of the grinding wheel and facilitate adjustment of the cutting bit face into a plane parallel to the grinding wheel face.

10. A method for sharpening a router or shaper bit having a flat cutting face, using a chuck for holding the bit and a shaft mounted grinding wheel having a flat cutting face perpendicular to the grinding wheel shaft, comprising the steps of:

a. attaching a thin, flat elongated magnetic strip to the face of the router or shaper bit;

b. positioning the bit ln the chuck and rotating the bit in the chuck so that the bit cutting face is in a plane having the same orientation with respect to the vertical the grinding face of the grinding wheel;

c. rotating the chuck so that the bit cutting face is in a plane parallel to the plane of the grinding face of the grinding wheel;

d. positioning the chuck so that the bit cutting face is in front of the grinding wheel face;

e. advancing the bit cutting face in small increments into and against the grinding wheel face in a motion that is parallel to the grinding wheel shaft;

wherein said magnetic strip exaggerates the angular difference between the plane of the bit face and the face of the grinding wheel thereby facilitating adjustment of the bit cutting face into a plane parallel to the grinding wheel face.

11. A method for sharpening a router or shaper bit having a flat cutting face, using a chuck for holding the bit and a shaft mounted grinding wheel having a flat grinding face perpendicular to the grinding wheel shaft, comprising the steps of:

a. positioning the bit in the chuck and rotating the bit in the chuck, using a laser, so that the bit cutting face is in a plane having the same orientation with respect to the vertical as the grinding face of the grinding wheel;

b. rotating the chuck, using a laser, so that the bit cutting face is in a plane parallel to the plane of the grinding face of the grinding wheel;

c. positioning the chuck so that the bit cutting face is in front of the grinding wheel face; and d. advancing the bit cutting face into and against the grinding wheel face in a motion that is parallel to the grinding wheel shaft.

12. A method for sharpening a router or shaper bit having a flat cutting face, using a chuck for holding the bit and a shaft mounted grinding wheel having a flat grinding face perpendicular to the grinding wheel shaft, comprising the steps of:

a. positioning the bit in the chuck and rotating the bit in the chuck so that the bit cutting face is in a plane having the same orientation with respect to the vertical as the grinding face of the grinding wheel;

b. rotating the chuck so that the bit cutting face is in a plane parallel to the plane of the grinding face of the grinding wheel;

c. positioning the chuck so that the bit cutting face is in front of the grinding wheel face;

d. advancing the bit cutting face in small increments into and against the grinding wheel face in a motion that is parallel to the grinding wheel shaft;

e. sharpening the bit cutting face by backwards and forwards movement of the bit cutting face in a motion perpendicular to the grinding wheel shaft;

f. withdrawing the bit cutting face away from the grinding wheel face following sharpening in a motion that is parallel to the grinding wheel shaft.

13. A method for sharpening a router or shaper bit having a flat cutting face comprising the steps of:

a. positioning the bit in a holder and positioning the holder so that the bit cutting face is in a plane parallel to and in front of the plane of the grinding face of an abrading wheel;

b. moving the bit cutting face into and against the grinding wheel face in a motion parallel to the grinding wheel shaft;

c. positioning the bit in a chuck and adjusting a rotational angle of the bit so that the bit cutting face is in a plane having the same orientation with respect to the vertical as the grinding face of an abrading wheel;

d. adjusting the angular orientation of the chuck so that the bit cutting face is in a plane parallel to the plane of the grinding wheel face;

e. said steps of c) and d) are accomplished with the aid of a laser;

f. positioning the chuck so that the bit cutting face is in front of the grinding wheel face; and g. advancing the bit cutting face into and against the grinding wheel face in a motion that is parallel to the grinding wheel shaft.

* * * * *